US010054355B2

(12) United States Patent
Jeon

(10) Patent No.: US 10,054,355 B2
(45) Date of Patent: Aug. 21, 2018

(54) ORIFICE FOR AIR CONDITIONER

(71) Applicant: LG ELECTRONICS INC., Seoul (KR)

(72) Inventor: Boohwan Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

(21) Appl. No.: 15/222,679

(22) Filed: Jul. 28, 2016

(65) Prior Publication Data

US 2017/0167773 A1 Jun. 15, 2017

(30) Foreign Application Priority Data

Dec. 14, 2015 (KR) ..... 10-2015-0178375

(51) Int. Cl.
*F25D 17/06* (2006.01)
*F25B 13/00* (2006.01)

(52) U.S. Cl.
CPC ..... *F25D 17/06* (2013.01); *F25B 13/00* (2013.01)

(58) Field of Classification Search
CPC ... F25D 17/06; F25D 3/11; F25D 3/12; F25D 3/127; F25D 13/062; F25B 31/00; F25B 21/02; F25B 21/04; F24F 17/06; F24F 5/80; F24F 1/40; F24F 1/38
USPC ..... 62/277
See application file for complete search history.

(56) References Cited

U.S. PATENT DOCUMENTS

2003/0123987 A1* 7/2003 Longet ..... F04D 29/164 416/223 R
2004/0156712 A1* 8/2004 Nadeau ..... F04D 29/164 415/174.5
2005/0172656 A1* 8/2005 Jung ..... F24F 1/26 62/324.1
2008/0267779 A1* 10/2008 Chiang ..... F04D 29/666 416/178
2010/0011803 A1* 1/2010 Warnecker ..... F24F 1/12 62/498
2011/0000653 A1* 1/2011 Nakagawa ..... F24F 1/38 165/121
2011/0174011 A1* 7/2011 Kim ..... F04D 19/007 62/426
2011/0192186 A1* 8/2011 Kato ..... F04D 29/162 62/324.3
2011/0318182 A1* 12/2011 Jeong ..... F04D 29/462 416/183

(Continued)

FOREIGN PATENT DOCUMENTS

CN 101196315 A 6/2008
EP 1 610 068 A1 12/2005

(Continued)

OTHER PUBLICATIONS

Translated abstract of JP 3359000.*

*Primary Examiner* — Mohammad M Ali
(74) *Attorney, Agent, or Firm* — Dentons US LLP

(57) ABSTRACT

An air conditioner including an orifice part provided at an outlet side of a fan, the orifice part having a main body with a ring shape and a noise blocking part which extends from the main body toward the fan and blocks a noise transmitted from the fan to a second heat exchange part, wherein the orifice part is configured to guide air discharged from the fan toward a discharge port.

20 Claims, 11 Drawing Sheets

(56) References Cited

U.S. PATENT DOCUMENTS

| | | | | |
|---|---|---|---|---|
| 2013/0236288 | A1* | 9/2013 | Fishler | F04D 29/663<br>415/1 |
| 2014/0299298 | A1* | 10/2014 | Kono | F24F 1/40<br>165/121 |
| 2015/0330223 | A1 | 11/2015 | Choi et al. | |

FOREIGN PATENT DOCUMENTS

| | | | | |
|---|---|---|---|---|
| EP | 2 233 847 | A1 | 9/2010 | |
| EP | 2 270 338 | A1 | 1/2011 | |
| EP | 2 343 458 | A1 | 7/2011 | |
| JP | 3-259000 | * | 11/1991 | F04D 29/32 |
| JP | 7-180862 | A | 7/1995 | |
| JP | 2011-179778 | A | 9/2011 | |
| JP | 2015-145767 | A | 8/2015 | |
| KR | 10-2008-0051593 | A | 6/2008 | |
| KR | 10-2014-0138508 | A | 12/2014 | |
| WO | 2007/148645 | A1 | 12/2007 | |
| WO | 2015/083371 | A1 | 6/2015 | |

* cited by examiner

ORIFICE FOR AIR CONDITIONER

CROSS-REFERENCE TO RELATED APPLICATION

This application claims priority under 35 U.S.C. § 119 and 35 U.S.C. § 365 to Korean Patent Application No. 10-2015-0178375, filed in Korea on Dec. 14, 2015, which is hereby incorporated by reference.

BACKGROUND

1. Field

An orifice for an air conditioner is disclosed herein.

2. Background

An air conditioner is a home appliance which maintains inside air at a desired state according to intended uses and purposes thereof. The air conditioner may have an inside unit and an outside unit. The air conditioner may be a separated type air conditioner in which the inside unit and the outside unit are separate from each other, or an integrated type air conditioner in which the inside unit and the outside unit are integrated in one unit.

The air conditioner is configured to drive a refrigeration cycle. Devices which drive the refrigeration cycle generally include a compressor to compress a refrigerant, a condenser to condense the compressed refrigerant, an expander to expand the condensed refrigerant, and an evaporator to evaporate the expanded refrigerant.

To increase a capacity of the outside unit, the number of rows of an outside heat exchanger in which a refrigerant exchanges heat may be increased. At this point, to increase the number of rows of the outside heat exchanger without increasing a size of the outside unit, a gap between elements installed inside the outside unit is relatively short.

For example, in the case of the outside unit including an outside heat exchanger which is bent in a relative "¬"-shape, the outside heat exchanger may be divided into a heat exchange part provided at a rear side of a fan, and a heat exchange part provided at a lateral side of the fan. A motor may be provided between the fan and the heat exchange part, and thus the heat exchange part and the fan may be disposed to be sufficiently spaced apart from each other. However, such configuration may be noisy because it does not include a separate element disposed between the fan and the heat exchange part.

Moreover, an axial flow fan is typically applied to the outside unit, which generates noise. The noise generated from the axial flow fan may be classified into a tonal noise and a broadband noise. The tonal noise includes a blade passing frequency (BPF) band noise. The BPF is a noise which is generated by a periodic disturbance of air at the fan, and is determined by a rotating speed of the fan and the number of blades. The BPF has a large magnitude at a narrow frequency band, which is undesirable.

Korean Patent Application Number 10-2014-0170184, titled "Fan, and outside unit of air conditioner having the same," describes a method which removes the BPF band noise using an expansion chamber or a resonator. Specifically, the application describes an expansion chamber or a resonator that may reduce the BPF band noise. However, with such configuration, a structure which guides the air should be additionally provided around the rotating fan. Such configuration requires that the size of the outside unit be increased, which is problematic.

To overcome the above problems, a structure which may expand the outside heat exchanger while the size of the outside unit is maintained, or a structure which prevents transmission of the noise generated from the blades of the fan is required.

SUMMARY

The present disclosure is directed to providing an orifice which prevents a fan noise from being transmitted to an outside.

Also, the present disclosure is directed to providing an orifice which prevents interference with an adjacent element such as a heat exchanger.

According to an aspect of the present disclosure, there is provided an air conditioner including a case having a suction port and a discharge port, a fan provided inside the case to generate a flow of air from the suction port toward the discharge port, an heat exchanger comprising a first heat exchange part which is provided at an inlet side of the fan, and a second heat exchange part which is bent and extends from the first heat exchange part, and an orifice part comprising a main body having a ring shape, and a noise blocking part which extends from the main body toward the fan, wherein the orifice part is provided at an outlet side of the fan to guide the air discharged from the fan toward the discharge port.

According to another aspect of the present disclosure, the noise blocking part is provided between a blade of the fan and the second heat exchange part.

According to yet another aspect of the present disclosure, the air conditioner further includes a partition wall to divide an internal space of the case into a heat exchange chamber in which the heat exchanger is provided and an electronic component chamber, wherein the orifice part is disposed between the second heat exchange part and the partition wall.

According to yet another aspect of the present disclosure, the orifice part further includes an air guide part which extends from an inner circumferential surface of the main body in a direction that intersects with an extension direction of the noise blocking part.

According to yet another aspect of the present disclosure, the noise blocking part extends in a backward direction from a side of the main body by a distance that is greater than or equal to 5 mm and less than or equal to 15 mm.

According to yet another aspect of the present disclosure, the noise blocking part has a varying length.

According to yet another aspect of the present disclosure, the length of the noise blocking part gradually increases and then gradually decreases from an upper side thereof toward a lower side thereof.

According to yet another aspect of the present disclosure, at least part of the fan extends inside the orifice part.

According to yet another aspect of the present disclosure, at least part of the fan extends inside the orifice part and the overlapping distance between the blade of the fan and the orifice is greater than or equal to 20 mm and less than or equal to 30 mm.

According to yet another aspect of the present disclosure, the noise blocking part blocks a noise of a blade passing frequency band from the fan.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings. It is understood that the description herein is not intended to limit the claims to the specific embodiments described. On the contrary, it is intended to cover alternatives, modifications, and equivalents as may be included within the spirit and scope of the present disclosure.

Figure 1:
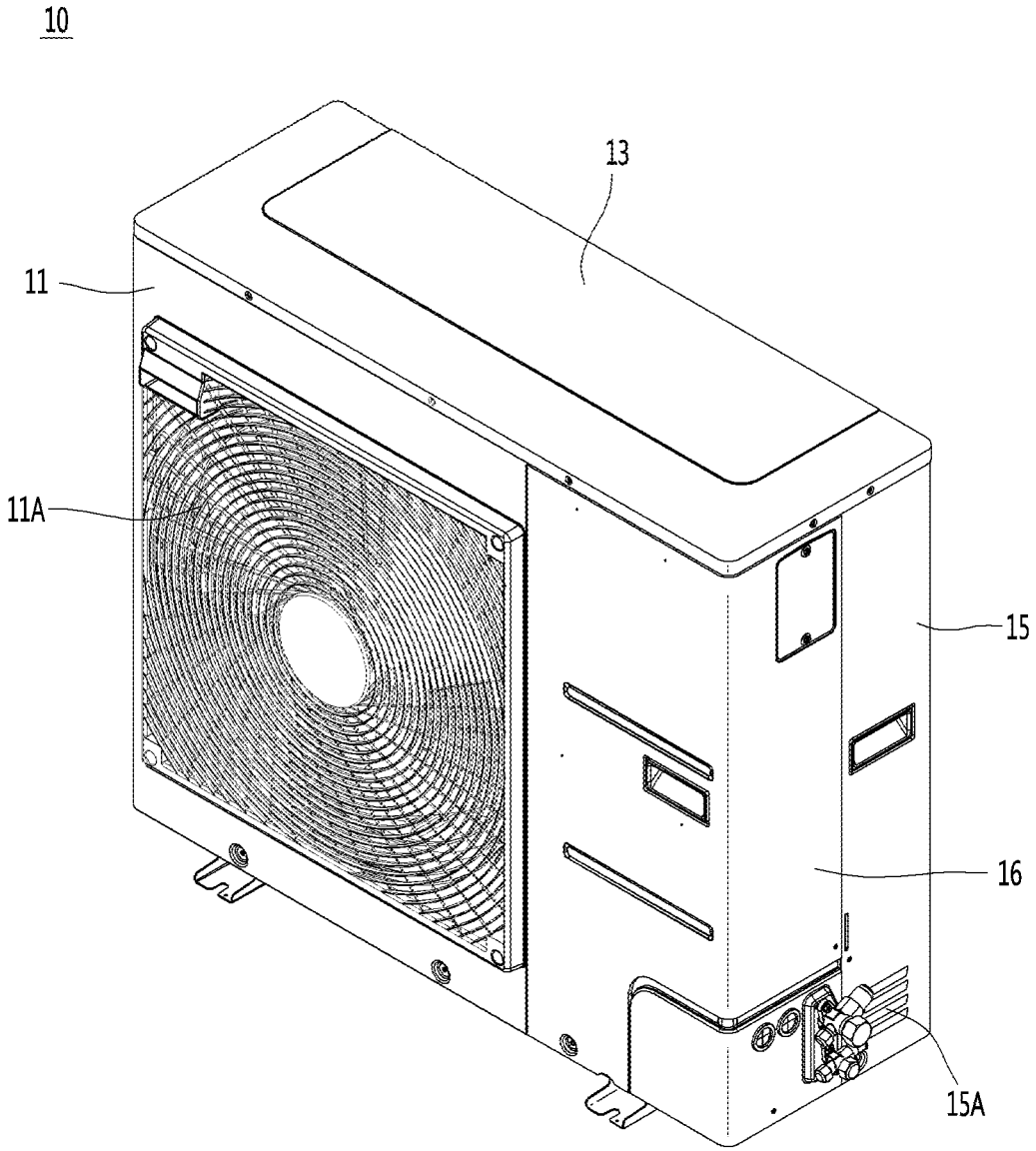
FIG. 1 is a perspective view of an outside unit of an air conditioner according to an embodiment of the present disclosure.
Figure 2:
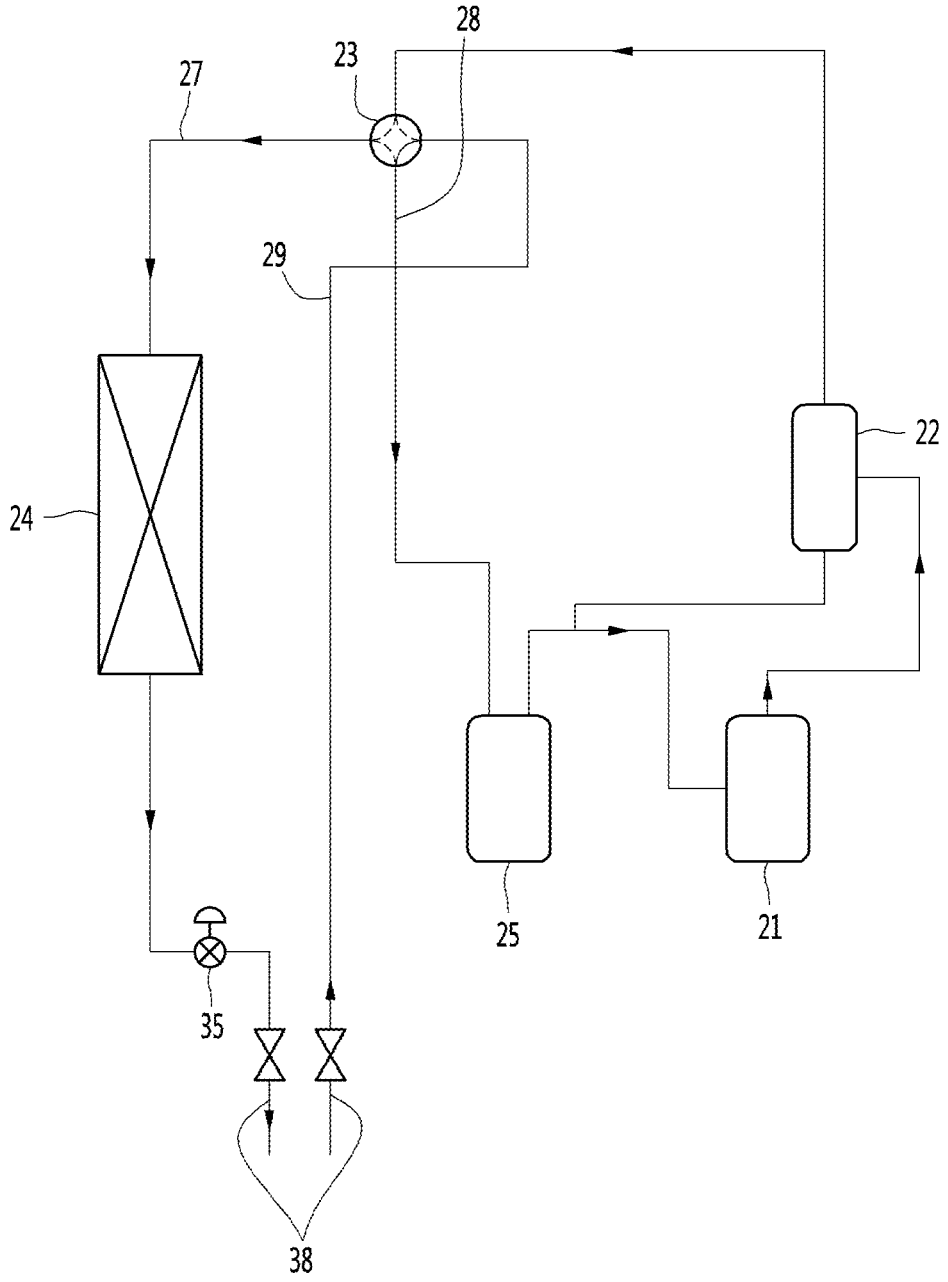
FIG. 2 is a perspective view illustrating a flow of a refrigerant and a configuration of the air conditioner according to an embodiment of the present disclosure.
Figure 3:
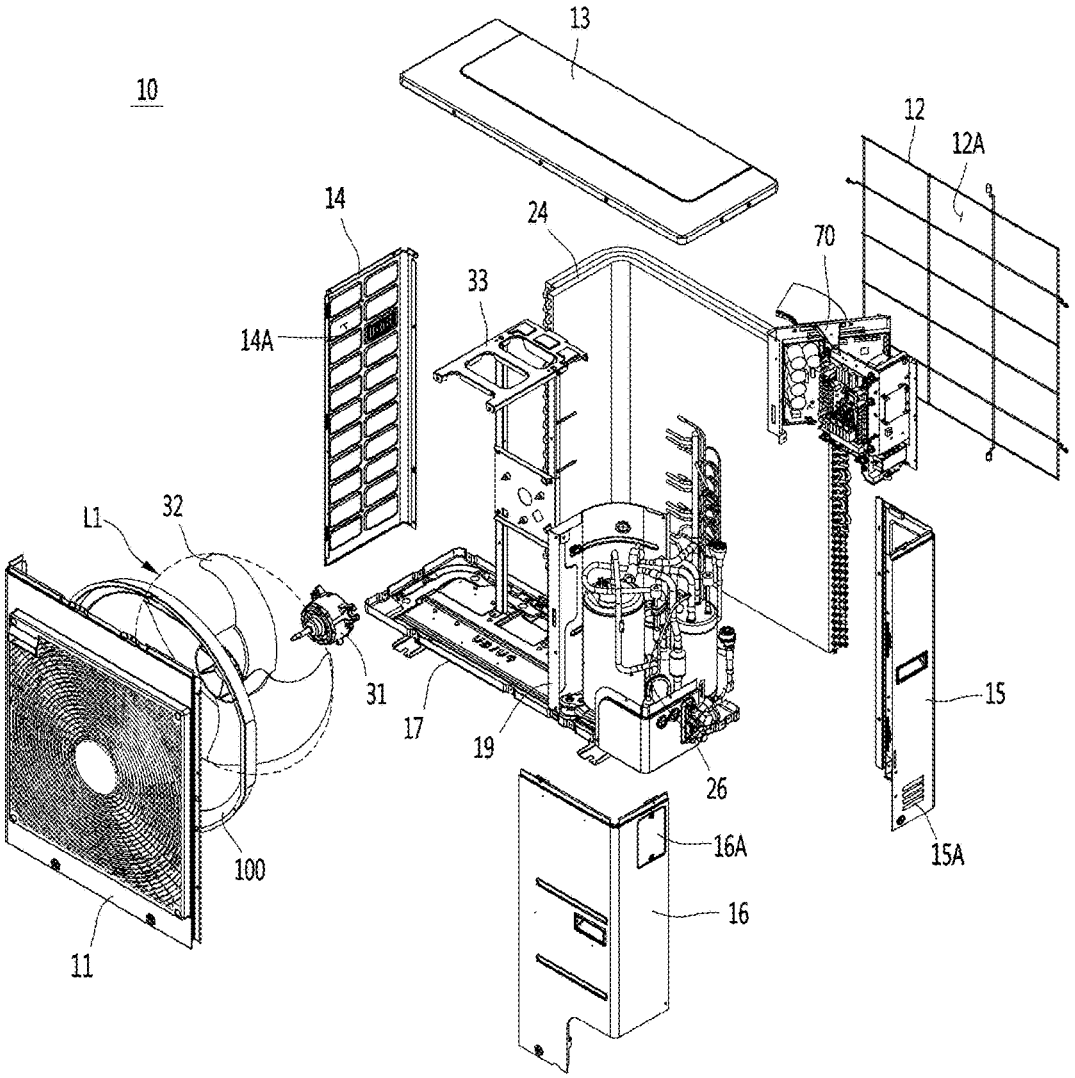
FIG. 3 is an exploded view of the outside unit of the air conditioner according to an embodiment of the present disclosure.
Figure 4:
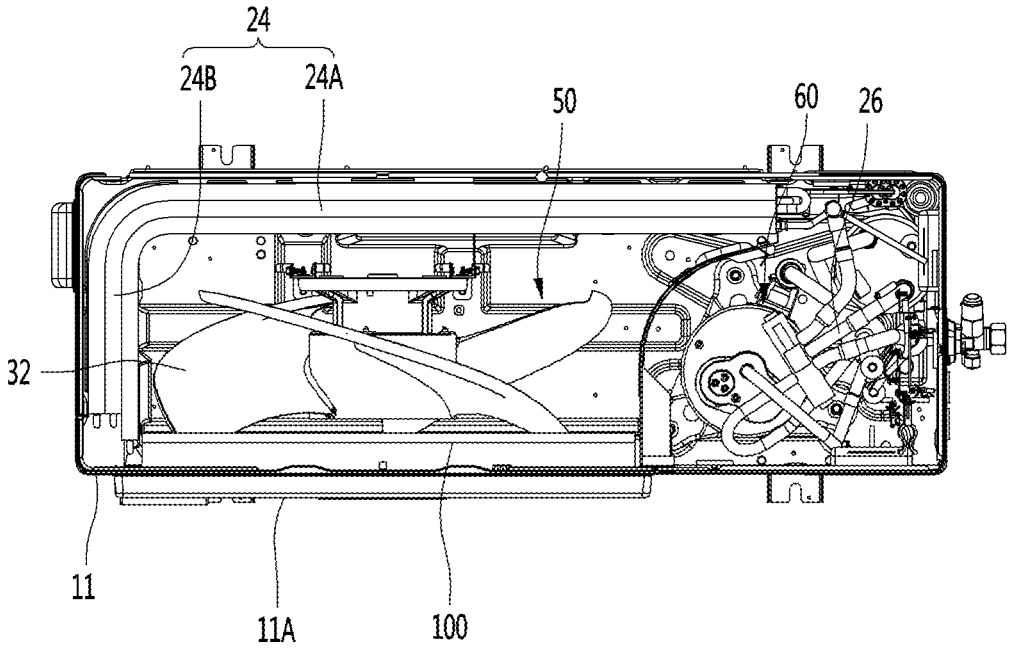
FIG. 4 is a cross-sectional view of the air conditioner according to an embodiment of the present disclosure.

FIG. 1 is a perspective view of an outside unit of an air conditioner according to an embodiment of the present disclosure, FIG. 2 is a perspective view illustrating a flow of a refrigerant and a configuration of the air conditioner according to the embodiment of the present disclosure, FIG. 3 is an exploded view of the outside unit of the air conditioner according to the embodiment of the present disclosure, and FIG. 4 is a cross-sectional view of the air conditioner according to the embodiment of the present disclosure.

Referring to FIGS. 1 through 4, an air conditioner includes an outside unit 10 which exchanges heat with outside air, and an inside unit (not shown) which is disposed at an inside space to condition inside air.

The outside unit 10 includes a case which forms an exterior and in which a plurality of components are provided. The case includes a front panel 11 which forms a front surface of the outside unit 10, a rear panel 12 which is spaced apart from the front surface and forms a back surface of the outside unit 10, an upper surface panel 13 which forms an upper surface of the outside unit 10, and side panels 14 and 15 which form both side surfaces of the outside unit 10. The front panel 11 may include a discharge port 11A. The rear panel 12 may include a suction port 12A. The side panels 14 and 15 may include suction ports 14A and 15A, respectively. The side panels 14 and 15 include a left panel 14 and a right panel 15.

The outside unit 10 includes an internal space or cavity surrounded by the case. A compressor or the like may be disposed inside the internal space.

The outside unit 10 may include the suction ports 12A, 14A and 15A through which the outside air is suctioned, and the discharge port 11A through which the suctioned air is discharged. The discharge port 11A may be formed at a front side of the outside unit 10, and the suction ports 12A, 14A and 15A may be formed at a rear side or a right or left side of the outside unit 10.

The outside unit 10 may further include a service panel 16. The service panel 16 may be formed to be rounded from the front surface of the outside unit 10 toward one side surface thereof.

Since the service panel 16 may open and close both of the front and the side with one panel, an installer or manager's access to an electronic component chamber may be easier. The service panel 16 may include a service cover 16A.

The outside unit 10 may include a base 17 which forms a lower surface of the outside unit 10, and the compressor or the like may be provided on an upper surface of the base 17. A lower surface of the base 17 may be in contact with a ground, and thus the outside unit 10 may be attached to the ground.

The outside unit 10 may include a partition wall 19 which extends in an upward direction from the base 17. The partition wall 19 may divide the internal space into a heat exchange chamber 50 and an electronic component chamber 60.

The heat exchange chamber 50 is understood to be a space in which a heat exchanger 24 and a fan 32 may be provided, and in which heat may be exchanged between a refrigerant passing through the heat exchanger 24 and air flowing by the fan 32. The electronic component chamber 60 is understood to be a space in which an electronic component part 70 may be provided. One surface of the partition wall 19 may be face the electronic component chamber 60, and the other surface thereof may face the heat exchange chamber 50.

The partition wall 19 may be a plate which extends vertically from the base. One end of the partition wall 19 may be coupled to the upper surface of the base 17, and the other end of the partition wall 19 may be coupled to the upper surface panel 13.

The partition wall 19 may include a curved surface which is formed to be rounded. The curved surface of the partition wall 19 may have a curvature corresponding to a configuration which is disposed at the electronic component part 70. The other surface of the partition wall 19 may be attached to one side of an orifice 100 which will be described below.

A compressor 21, an oil separator 22, a flow switching part 23, an outside heat exchanger 24, a expansion valve 35, a gas-liquid separator 25 and a plurality of refrigerant pipes 26 may be provided inside the outside unit 10.

Specifically, the outside unit 10 may include the compressor 21 which compresses the refrigerant, and the oil separator 22 may be provided at an outlet side of the compressor 21 to separate oil from the refrigerant discharged from the compressor 21.

The flow switching part 23 which guides the refrigerant discharged from the compressor 21 toward the outside heat exchanger 24 or the inside unit (not shown) is provided at an outlet side of the oil separator 22. For example, the flow switching part 23 may include a 4-way valve.

The flow switching part 23 may be connected to a first connection pipe 27 which is connected to the outside heat exchanger 24, a second connection pipe 28 which is connected to the gas-liquid separator 25, and a third connection pipe 29 which is connected to the inside unit (not shown).

When the air conditioner performs a cooling operation, the refrigerant is introduced from the flow switching part 23 into the outside heat exchanger 24 through the first connection pipe 27. However, when the air conditioner performs a warming operation, the refrigerant is introduced from the flow switching part 23 into an inside heat exchanger of the inside unit (not shown) through the third connection pipe 29.

In the outside heat exchanger 24, heat is exchanged between the external air and the refrigerant, and the outside heat exchanger 24 functions as the condenser when the air conditioner performs the cooling operation, and also functions as the evaporator when the air conditioner performs the warming operation.

The outside heat exchanger 24 may include a plurality of rows, and may be bent in a relative "¬"-shape. The outside heat exchanger 24 may be located proximate to two adjacent panels of the rear panel 12, the left panel 14 and the right panel 15 in the internal space. For example, the outside heat exchanger 24 may be located proximate to the rear panel 12 and the left panel 14.

The outside heat exchanger 24 includes a first heat exchange part 24A and a second heat exchange part 24B. The second heat exchange part 24B may be bent and extend from the first heat exchange part 24A.

For example, the outside heat exchanger 24 may include the first heat exchange part 24A which is located corresponding to the rear panel 12, and the second heat exchange part 24B which is bent and extends from the first heat exchange part 24A and is located corresponding to the left panel 14.

The first heat exchange part 24A and the second heat exchange part 24B may each include an introduction surface through which the external air is introduced into the heat exchanger, and a discharge surface through which the air passed through the heat exchanger is discharged. Accordingly, the introduction surface is a surface which is directed toward the rear panel 12 or the left panel 14 based on the inside heat exchanger, and the discharge surface is a surface which is directed toward the internal space of the outside unit 10.

Thus, when the air conditioner performs the cooling operation, the refrigerant passed through the outside heat exchanger 24 passes through the expansion valve 35. That is, the expansion valve 35 may be disposed at an outlet side of the outside heat exchanger 24 based on the cooling operation. For example, when the cooling operation is performed, the main expansion valve 35 may be completely opened, and thus a decompressing action of the refrigerant is not performed.

The refrigerant passed through the expansion valve 35 may flow to the inside unit through an inside pipe 38, and the refrigerant evaporated in the inside heat exchanger (not shown) may be introduced into the outside unit 10 through the inside pipe 38.

The refrigerant introduced into the outside unit may be introduced into the flow switching part 23 through the third connection pipe 29, and discharged from the flow switching part 23 through the second connection pipe 28.

The refrigerant passed through the flow switching part 23 may flow to the gas-liquid separator 25. The gas-liquid separator 25 may separate a gas refrigerant before the refrigerant is introduced into the compressor 21, and the separated gas refrigerant may be introduced into the compressor 21.

The outside unit 10 may further include at least one of a motor 31, the fan 32 and a motor bracket 33.

The motor 31 may function to provide a rotating force to the fan 32. The fan 32 may be attached to a rotating shaft of the motor 31, thus enabling the air to flow by the rotating force. The motor 31 may be attached to the motor bracket 33. The motor bracket 33 may support both the motor 31 and the fan 32.

The fan 32 may include a hub which is attached to the rotating shaft, and a plurality of blades which are provided at an outer circumferential surface of the hub.

Each of the plurality of blades includes a leading edge and a trailing edge. Each of the plurality of blades may further include a tip which forms an outermost end in a radial direction. An imaginary extension line which extends from the rotating tip may be referred to as a rotation route L1.

The fan 32 may be provided at the front panel 11 so as to correspond to the discharge port 11A. The motor bracket 33 may be provided between the base 17 and the upper surface panel 13. For example, one end of the motor bracket 33 may be attached to the upper surface of the base 71, and the other end of the motor bracket 33 may be attached to a lower surface of the upper surface panel 13, and the motor 31 attached to a front surface of the motor bracket 33 may be provided so as to correspond to the discharge port 11A. The fan 32, the motor 31, the motor bracket 33, and the first heat exchange part 24A may be arranged, in turn, from a front side toward a rear side at the heat exchange chamber 50.

Figure 5:
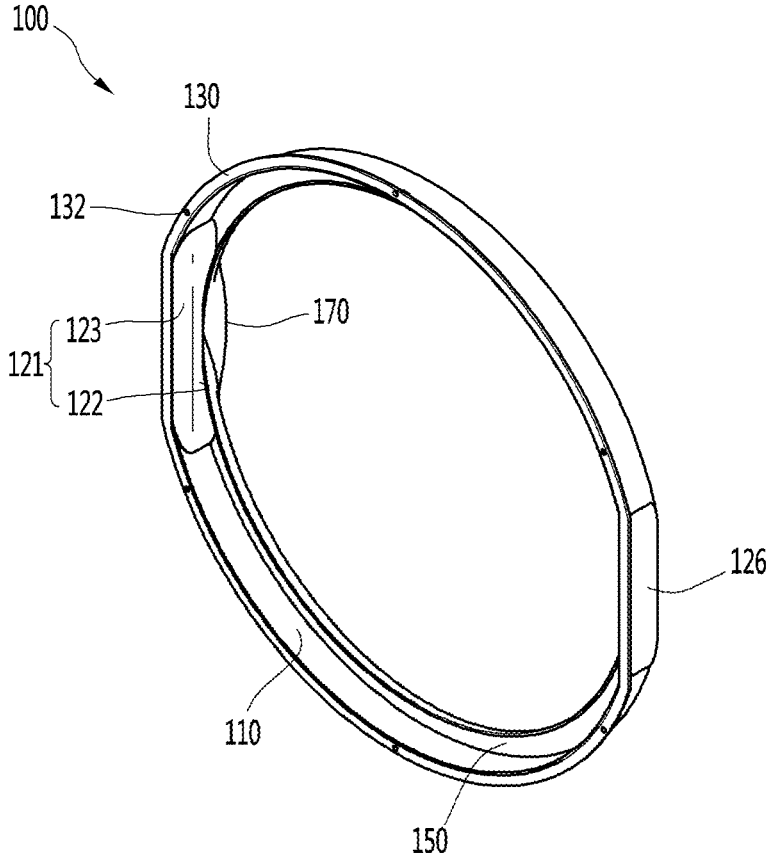
FIG. 5 is a perspective view illustration of a right front side of an orifice according to an embodiment of the present disclosure.
Figure 6:
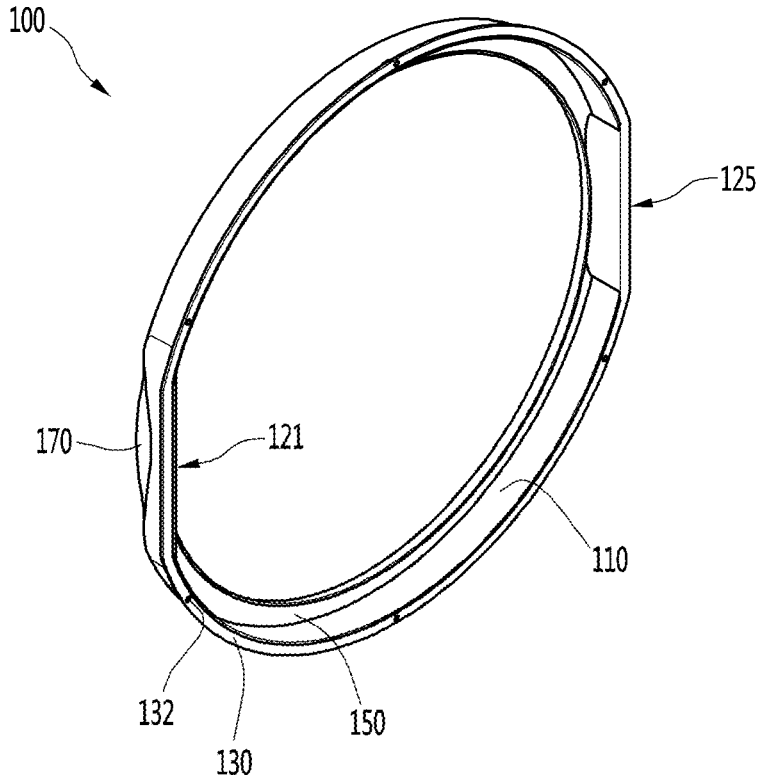
FIG. 6 is a perspective view illustration of a left front side of the orifice according to an embodiment of the present disclosure.
Figure 7:
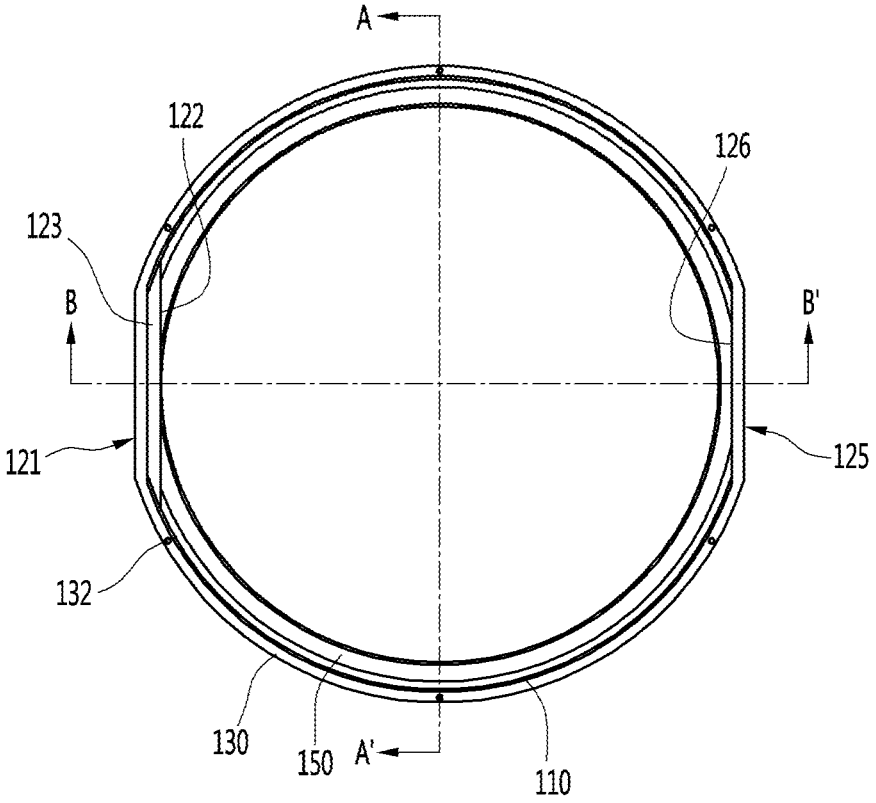
FIG. 7 is a front view of the orifice according to an embodiment of the present disclosure.
Figure 8:
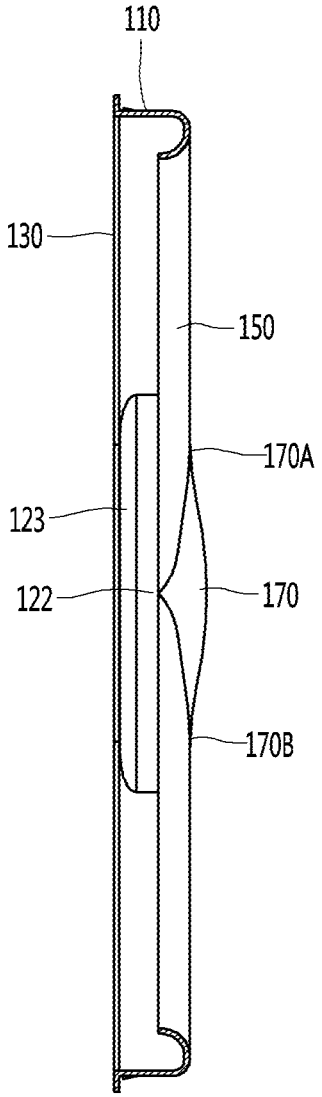
FIG. 8 is a cross-sectional view taken along line A-A' of FIG. 7.
Figure 9:
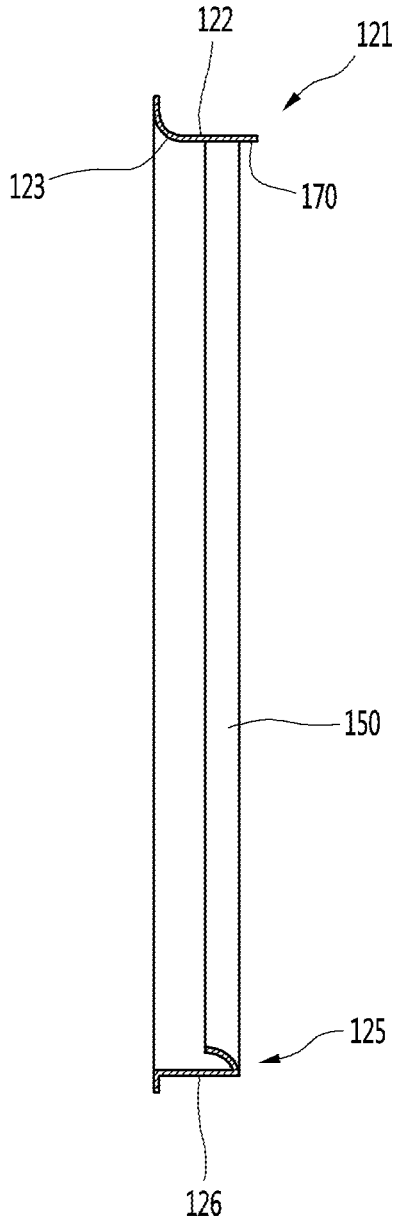
FIG. 9 is a cross-sectional view taken along line B-B' of FIG. 7.
Figure 10:
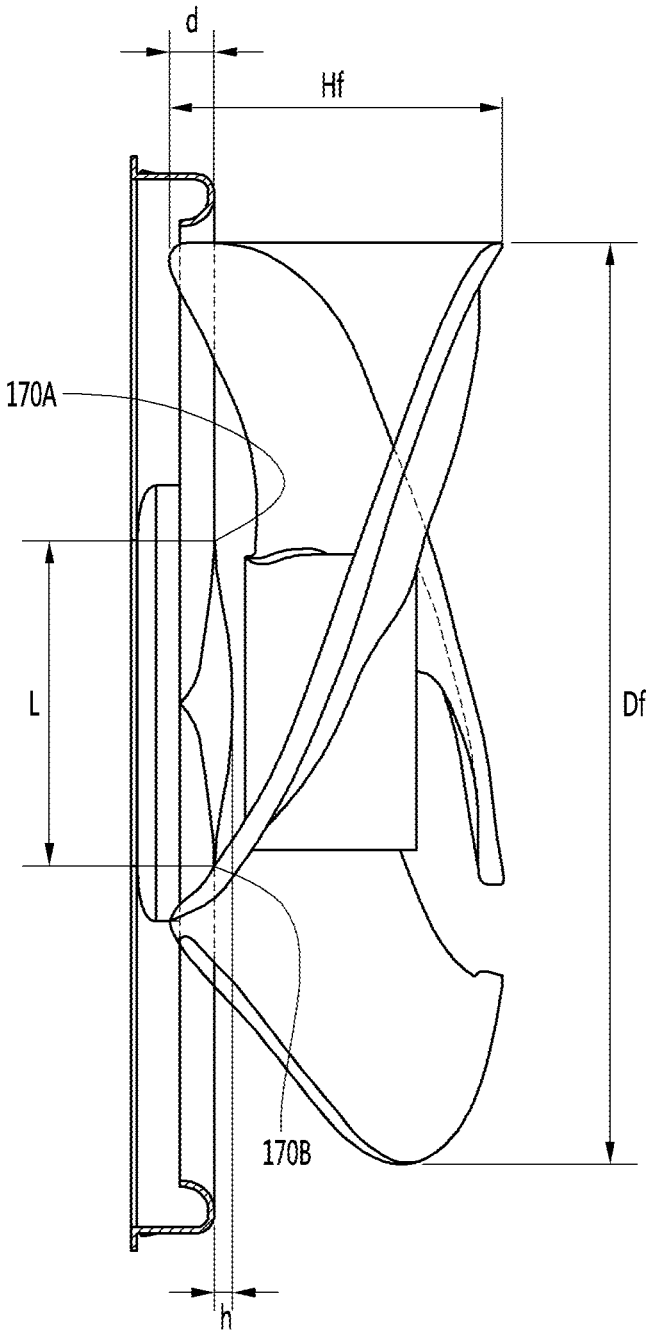
FIG. 10 is a view illustrating sizes and relative positions of the orifice and a fan according to an embodiment of the present disclosure.

FIG. 5 is a perspective view illustrating an orifice according to the embodiment of the present disclosure when viewed from a right front side, FIG. 6 is a perspective view illustrating the orifice according to the embodiment of the present disclosure when viewed from a left front side, FIG. 7 is a front view of the orifice according to the embodiment of the present disclosure, FIG. 8 is a cross-sectional view taken along line A-A' of FIG. 7, FIG. 9 is a cross-sectional view taken along line B-B' of FIG. 7, and FIG. 10 is a view illustrating sizes and relative positions of the orifice and the fan according to the embodiment of the present disclosure.

Referring to FIGS. 5 through 10, the outside unit 10 includes the orifice 100 which is provided between the discharge port 11A and the fan 32. The orifice 100 may be attached to the front panel 11. More specifically, as shown, the orifice 100 may be provided between the front panel 11 and the fan 32 in a forward and backward direction, and may be provided between the second heat exchange part 24B and the partition wall 19 in a left and right direction.

The orifice 100 may guide the air flowing from the fan 32 toward the discharge port 11A. The orifice 100 may prevent a noise generated by rotation of the fan 32 from being transmitted to an outside of the outside unit 10 through the second heat exchange part 24B.

The orifice 100 may be formed in a ring-like shape. The shape of the orifice 100 may have a size corresponding to a diameter of the discharge port 11A and may include a curved surface having a predetermined curvature, and a portion of the blades of the fan 32 may be accommodated inside the orifice 100. The portion of the blades of the fan 32 accommodated inside the orifice 100 may include a point at which the leading edge and the tip meet.

A front end of the orifice 100 may be in contact with a rear surface of the front panel 11, and thus correspond with the discharge port 11A. A rear end of the orifice 100 may be disposed toward the fan 32.

The orifice 100 may include a main body 110 which is located outside the rotation route L1 (referring to FIG. 3) of the fan 32 at one side of the fan 32. The main body 110 may be formed to be slightly spaced apart toward an outlet side of the fan 32 and to surround the fan 32.

The orifice 100 may include fastening guide parts 121 and 125 which protrude inward from an inner circumferential surface of the main body 110 in a radial direction. The fastening guide parts 121 and 125 may function to prevent the main body 110 from interfering with other elements adjacent to the main body 110. The fastening guide parts 121 and 125 may also function to guide the orifice 100 to be fastened between other elements adjacent to the orifice 100. For example, the fastening guide parts 121 and 125 may guide the orifice 100 to be fastened to a space formed between the second heat exchange part 242 and the partition wall 19.

A plurality of fastening guide parts 121 and 125 may be provided according to the number of other adjacent elements. That is, the fastening guide parts 121 and 125 may include a first fastening guide part 121 which is provided at one side of the main body 110, and a second fastening guide part 125 which is provided at the other side of the main body 110.

For example, the fastening guide parts 121 and 125 may include the first fastening guide part 121 which is formed at a side of the second heat exchange part 242 of the main body 110 to prevent interference with the second heat exchange part 242, and the second fastening guide part 125 which is formed at a side of the partition wall 19 of the main body 110 to prevent interference with the partition wall 19. That is, the first fastening guide part 121 is formed at a portion of the orifice 100 at which the interference with the second heat exchange part 242 may occur, and the second fastening guide part 125 is formed at a portion of the orifice 100 at which the interference with the partition wall 19 may occur.

The fastening guide parts 121 and 125 may be formed to have shapes corresponding to the shapes of other adjacent elements.

For example, the first fastening guide part 121 may include a first flat surface part 122 having the same shape as that of one side surface of the second heat exchange part 242, and the second fastening guide part 125 may include a second flat surface part 126 having the same shape as that of a rear surface of the partition wall 19.

As another example, the first fastening guide part 121 may further include a curved surface part 123.

The curved surface part 123 may extend from the first flat surface part 122 to the main body 110, and may be formed in a curved surface having a predetermined curvature. The curved surface part 123 may minimize friction with air. The curved surface part 123 may have another curvature according to a height of each of the fastening guide parts 121 and 125 which protrudes from the main body 110.

The first fastening guide part 121 and the second fastening guide part 125 may be provided at both sides of the orifice 100 to correspond to each other, but are not limited thereto. The first fastening guide part 121 and the second fastening guide part 125 may be provided without regard to each other.

For example, the first fastening guide part 121 may include the first flat surface part 122 and the curved surface part 123 which extends from the first flat surface part 122, and the second fastening guide part 125 may include the second flat surface part 126.

The first fastening guide part 121 may be formed to have a protruding depth that is deeper than that of the second fastening guide part 125.

The orifice 100 may include a front surface part 130 which extends from a front end of the main body 110 or a front end of each of the first and second fastening guide parts 121 and 125. With such configuration, the fan 32 functions to move the air in a rear of the outside unit 10 to a front of the outside unit 10, and the air is introduced to the rear end of the orifice 100, and then discharged to the front end of the orifice 100. The front end may be understood as an 'outlet end', and the rear end may be understood as an 'inlet end'.

That is, a direction from the fan toward the discharge port may be referred to as a front side, and an opposite direction thereto may be referred to as a rear side. And left and right directions based the front side may be referred to as lateral sides, and an extension direction of the shaft of the fan may be referred to as an axial direction, and a direction vertical to the axial direction may be defined as a radial direction.

The front surface part 130 may be bent and extend outward from the front end, i.e., the outlet end of the main body 110 in the radial direction of the main body 110. The front surface part 130 may contact the rear surface of the front panel 11. Thus, it is understood that the front surface part 130 may be bent outward from front ends of the fastening guide parts 121 and 125 in the radial direction of the fastening guide parts 121 and 125.

The front surface part 130 may include a fastening part 132 which passes through the front surface part 130. The front panel 11 and the fastening part 132 may be coupled together by a fastening member (not shown).

The orifice 100 may include an air guide part 150 which extends from a rear end of the main body 110. The air guide part 150 may guide the air flowing from the fan 32 to an inside of the orifice 100.

The air guide part 150 may include a curved surface which extends from the rear end of the main body 110 to a rear of the main body 110 so as to be rounded toward the inner circumferential surface of the main body 110. And one end of the extending curved surface may be formed toward a front of the main body 110. That is, the air guide part 150 may form the curved surface which is convex toward a rear of the air guide part 150.

That is, the air guide part 150 may extend from the inlet end of the main body 110 and be rounded with a curvature which is set in a direction opposite to the fan 32. Thus, the air guide part 150 may be formed to be rounded, such that a diameter of the air guide part 150 becomes gradually smaller.

The air guide part 150 may extend from the fastening guide parts 121 and 125. For example, one portion of the air guide part 150 which extends from the fastening guide parts 121 and 125 may be integrally formed with another portion of the air guide part 150 which extends from the rear end of the main body 110. Therefore, the air guide part 150 may extend forward from inner side surfaces of the fastening guide parts 121 and 125.

The orifice 100 may include an extending part 170 which extends backward from the rear end of the main body 110. The extending part 170 may be provided between the fan 32 and the second heat exchange part 242. The extending part 170 may prevent noise generated by the rotation of the fan 32 from being transmitted to the second heat exchange part 242. The extending part 170 thus functions to block the noise, and may be understood as a "noise blocking part."

The extending part 170 may extend from one end of the main body 110 and have different lengths in the axial direction. That is, the extending part 170 may have an axial length h which extends from the rear end of the main body 110 in the axial direction.

For example, the axial length h may be greater than or equal to 5 mm and less than or equal to 15 mm, and the extending part 170 may be provided to be vertically symmetrical with respect to a point having a maximum axial length h. The axial length h of the extending part 170 may be changed according to a height Hf of the fan 32.

Thus, the extending part 170 may extend downward from a first point 170A of the main body 110, and may be connected to a second point 170B of the main body 110. That is, the extending part 170 may have a circumferential length L which extends from the first point 170A of the main body 110 to the second point 170B of the main body 110.

A length of the extending part 170 which extends from the main body 110 toward the fan 32 may be longitudinally different. The point having the maximum axial length h may be located between the first point 170A and the second point 170B. The circumferential length L of the extending part 170 may be changed according to a diameter Df of the fan 32.

The fan 32 may be provided so as to be overlapped to an inside of the orifice 100 by a predetermined distance. That is, the point at which the leading edge and the tip of the blade meet may be accommodated inside the orifice 100. For example, an overlapping distance d between the blade and the orifice 100 may be greater than or equal to 20 mm and less than or equal to 30 mm.

Thus, because the blade may be moved forward and backward according to RPM of the motor 31 or an air volume, the overlapping distance d between the blade and the orifice 100 may be varied according to the RPM of the motor 31.

Figure 11A:
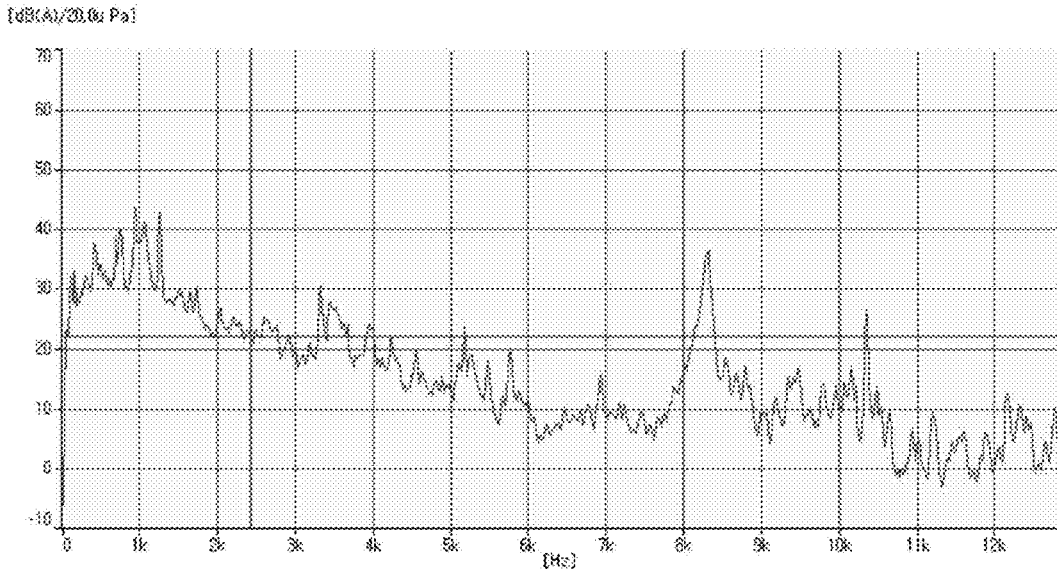
FIG. 11A is a view illustrating noise reduction performance showing a result value of the noise which is measured from the outside of the outside unit when an extending part is not provided according to an embodiment of the present disclosure.
Figure 11B:
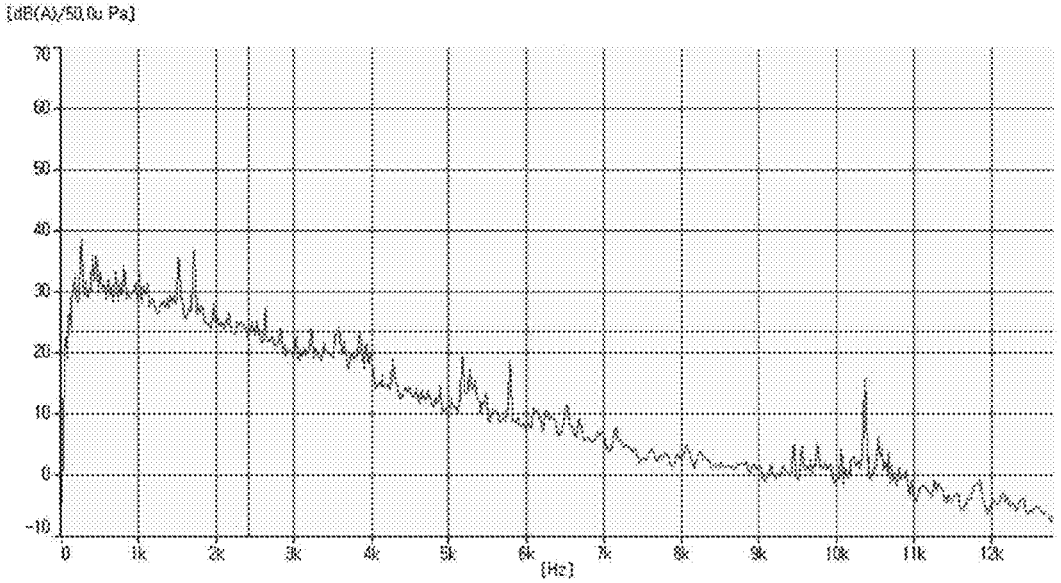
FIG. 11B is a view illustrating noise reduction performance showing a result value of the noise when the extending part is provided according to an embodiment of the present disclosure.

FIG. 11 is a view illustrating noise reduction performance according to the embodiment of the present disclosure. FIG. 11A illustrates a result value of the noise which is measured from the outside of the outside unit when the extending part 170 is not provided, and FIG. 11B illustrates a result value of the noise when the extending part 170 extends from the main body 110 by approximately 10 mm.

Referring to FIG. 11 and FIG. 11A, a noise of approximately 40 dB is measured at a frequency band of 0 to 2 kHz, and a noise of approximately 35 dB is measured at a frequency band of 7 to 9 kHz. However, in FIG. 11B, a noise of approximately 30 dB is measured at a frequency band of 0 to 2 kHz, and a noise of approximately 5 dB is measured at a frequency band of 7 to 9 kHz.

Such results show that the noise at the BPF band of 0 to 2 kHz or 7 to 9 kHz is reduced.

According to the present disclosure, because a size of the heat exchanger can be increased without increasing a size of the outside unit, performance of the air conditioner can be improved. Moreover, even when the size of the heat exchanger is increased, the noise of the fan which passes through the heat exchanger and is transmitted to the outside thereof can be reduced. Additionally, because an expansion chamber or a resonator for reducing the noise generated from the outside unit is not required, a manufacturing cost can be reduced and/or productivity can be enhanced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a case having a suction port and a discharge port;

a fan provided inside the case to generate a flow of air from the suction port toward the discharge port;

a heat exchanger comprising a first heat exchange part which is provided at an inlet side of the fan, and a second heat exchange part which is bent and extends from the first heat exchange part; and an orifice part provided at an outlet side of the fan to guide the air discharged from the fan toward the discharge port, wherein the orifice part comprises:

a main body having a ring shape and extending from the discharge port to the fan, a first flat surface part formed at one side of the main body that is adjacent to the heat exchanger, and an extending part extended toward the fan from one portion of the flat surface part to block a noise from the fan.

2. The air conditioner of claim 1, wherein the extending part is provided between a blade of the fan and the second heat exchange part.

3. The air conditioner of claim 2, wherein the extending part is provided between a rotation route of the blade and a surface of the second heat exchange part.

4. The air conditioner according to claim 1, wherein the case comprises a front panel, a rear panel, a right side panel, and a left side panel, whereby the lengths of the right and left side panels are smaller than the lengths of the front and rear panels.

5. The air conditioner of claim 4, wherein the first heat exchange part extends in a direction corresponding to an extension direction of the rear panel, and the second heat exchange part extends in a direction corresponding to an extension direction of the side panel.

6. The air conditioner of claim 4, wherein the discharge port is disposed at the front panel.

7. The air conditioner of claim 2, comprising a partition wall to divide an internal space of the case into a heat exchange chamber in which the heat exchanger is provided and an electronic component chamber, wherein the orifice part is disposed between the second heat exchange part and the partition wall.

8. The air conditioner of claim 7, wherein the orifice part further comprises:

a first fastening guide part which is provided at a first side of the main body and guides a fastening between the second heat exchange part and the main body; and a second fastening guide part which is provided at a second side of the main body and guides a fastening between the partition wall and the main body.

9. The air conditioner of claim 8, wherein the first fastening guide part comprises the first flat surface part having the same shape as a surface of the second heat exchange part.

10. The air conditioner of claim 8, wherein the second fastening guide part comprises a second flat surface part having the same shape as a surface of the partition wall.

11. The air conditioner of claim 1, wherein the orifice part further comprises an air guide part which extends from an inner circumferential surface of the main body in a direction that intersects with an extension direction of the extending part.

12. The air conditioner of claim 1, wherein the extending part extends in a backward direction from a side of the main body by a distance that is greater than or equal to 5 mm and less than or equal to 15 mm.

13. The air conditioner of claim 1, wherein the extending part extends downward from a first point of the main body and is connected to a second point of the main body.

14. The air conditioner of claim 1, wherein the extending part that extends from the flat surface part toward the fan has a varying length.

15. The air conditioner of claim 14, wherein the length of the extending part gradually increases and then gradually decreases from an upper side thereof toward a lower side thereof.

16. The air conditioner of claim 15, wherein the length of the extending part is a circumferential length.

17. The air conditioner of claim 1, wherein at least part of the fan extends inside the orifice part.

18. The air conditioner of claim 17, wherein the leading edge and tip of a blade of the fan is disposed inside the orifice part.

19. The air conditioner of claim 18, wherein an overlapping distance between the blade and the orifice is greater than or equal to 20 mm and less than or equal to 30 mm.

20. The air conditioner of claim 1, wherein the orifice part further comprises a second flat surface part formed at other side of the main body to face the first surface part.

* * * * *